US005959234A

United States Patent [19]

Scaramucci et al.

[11] Patent Number: 5,959,234

[45] **Date of Patent: *Sep. 28, 1999**

[54] GAS-OPERATED AUTOMATIC FIREARM, PARTICULARLY A SHOTGUN

[75] Inventors: Sergio Scaramucci, Gallo Di Petriano; Rolando Caldari, Urbino, both of Italy

[73] Assignee: Benelli Armi S.p.A., Italy

[ * ] Notice: This patent issued on a continued prosecution application filed under 37 CFR 1.53(d), and is subject to the twenty year patent term provisions of 35 U.S.C. 154(a)(2).

[21] Appl. No.: 08/792,288

[22] Filed: Jan. 31, 1997

[51] Int. Cl.[6] ..... F41A 5/22; F41A 5/26

[52] U.S. Cl. ..... 89/193

[58] Field of Search ..... 89/193, 192, 191.01, 89/191.02

[56] References Cited

U.S. PATENT DOCUMENTS

| | | | |
|---|---|---|---|
| 933,098 | 9/1909 | McClean | 89/191.01 |
| 1,388,856 | 8/1921 | Fox . | |
| 2,144,241 | 1/1939 | Eiane . | |
| 2,494,889 | 1/1950 | Maillard | 89/193 |
| 2,887,013 | 5/1959 | Marsh | 89/193 |
| 3,125,930 | 3/1964 | Gilbert | 89/191.01 |
| 3,289,535 | 12/1966 | Hupp . | |
| 3,999,461 | 12/1976 | Johnson et al. | 89/191.01 |
| 4,015,512 | 4/1977 | Feerick | 89/192 |
| 4,102,242 | 7/1978 | Liedke | 89/191.01 |
| 4,270,437 | 6/1981 | Donovan | 89/192 |
| 5,388,500 | 2/1995 | Petrovich | 89/194 |
| 5,404,790 | 4/1995 | Averbukh | 89/193 |

FOREIGN PATENT DOCUMENTS

| | | | |
|---|---|---|---|
| 390 196 | 5/1908 | France . | |
| 68 279 | 4/1958 | France . | |
| 19463 | 5/1899 | Switzerland . | |
| 89832 | 11/1917 | Switzerland . | |
| 365976 | 1/1963 | Switzerland | 89/193 |
| 747371 | 4/1956 | United Kingdom | 89/191.01 |

*Primary Examiner*—Stephen M. Johnson
*Attorney, Agent, or Firm*—R. Neil Sudol; Henry D. Coleman

[57] ABSTRACT

Gas-operated automatic weapon, including a barrel having a cylindrical portion that is blended with a cartridge chamber which can be closed by a breech block, wherein it includes a gas take-off that is located proximate to the cartridge chamber and is suitable to draw a fraction of the gases generated by the cartridge to actuate a piston that is suitable to open the breech block for automatic reloading of the weapon.

4 Claims, 3 Drawing Sheets

GAS-OPERATED AUTOMATIC FIREARM, PARTICULARLY A SHOTGUN

BACKGROUND OF THE INVENTION

1. Field of the invention

The present invention relates to a gas-operated automatic firearm, particularly a shotgun.

2. Description of the Prior Art

Autoloading shotguns generally include a bolt mechanism linked to a piston and cylinder assembly which is operated by a portion of the gas generated on discharge of a round and bled from the gun barrel to the cylinder.

The gas port is generally arranged approximately in the median third of the bore, slightly more than halfway along the length of the barrel.

There are a few problems connected with auto-loading gas-operated shotguns.

A main problem of auto-loading shotguns is the necessity to fire shells of different power and to ensure a correct operation with the weakest shells, the gas port section is rather large to allow the passage of a sufficient portion of gas. Also the diameter of the piston has to be greater than that of the bore.

Another problem of conventional gas-operated shotguns is that the barrel must have a minimum length due to the forward position of the gas port. It is however desirable to provide auto-loading shotguns with a shorter barrel.

U.S. Pat. No. 4,102,242 discloses a gas-operated shotgun provided with a pair of gas cylinders mounted on opposite sides of the barrel at a somewhat forward position of the barrel. The cylinders have respective pistons engaging an inertial weight slidably mounted on the magazine. The inertial weight is connected to the bolt mechanism by a pair of action bars. The barrel of this shotgun must have a minimum length set by the forward position of gas cylinders and related gas ports.

The aim of the present invention is to provide a gas operated shotgun, wherein the length of the barrel can be selected as desired while always ensuring a perfect automatic operation.

Within the scope of this aim, an object of the invention is to provide a gas operated shotgun with an improved automatic operation with respect to conventional gas operated shotguns even, especially, for example, when firing low power ammunition.

A further object of the invention is to provide a gas-operated shotgun wherein the expansion chamber and the piston are less subject to clogging.

SUMMARY OF THE INVENTION

This aim, these objects and others, which will become apparent to those skilled in the art, are achieved by a gas-operated automatic firearm comprising: a barrel that forms a cylindrical portion that is blended with a cartridge chamber which can be closed by a breech block; a gas port means located proximate to the cartridge chamber and adapted to draw a portion of the gas generated on discharge of a round to actuate a piston means adapted to open the breech, for automatically re-loading the firearm.

Further characteristics and advantages of the invention will become apparent from a reading of the detailed description of a preferred but not exclusive embodiment of a firearm according to the invention, illustrated only by way of a non-limiting example in the accompanying drawings.

DESCRIPTION OF THE PREFERRED EMBODIMENTS OF THE INVENTION

Figure 1:
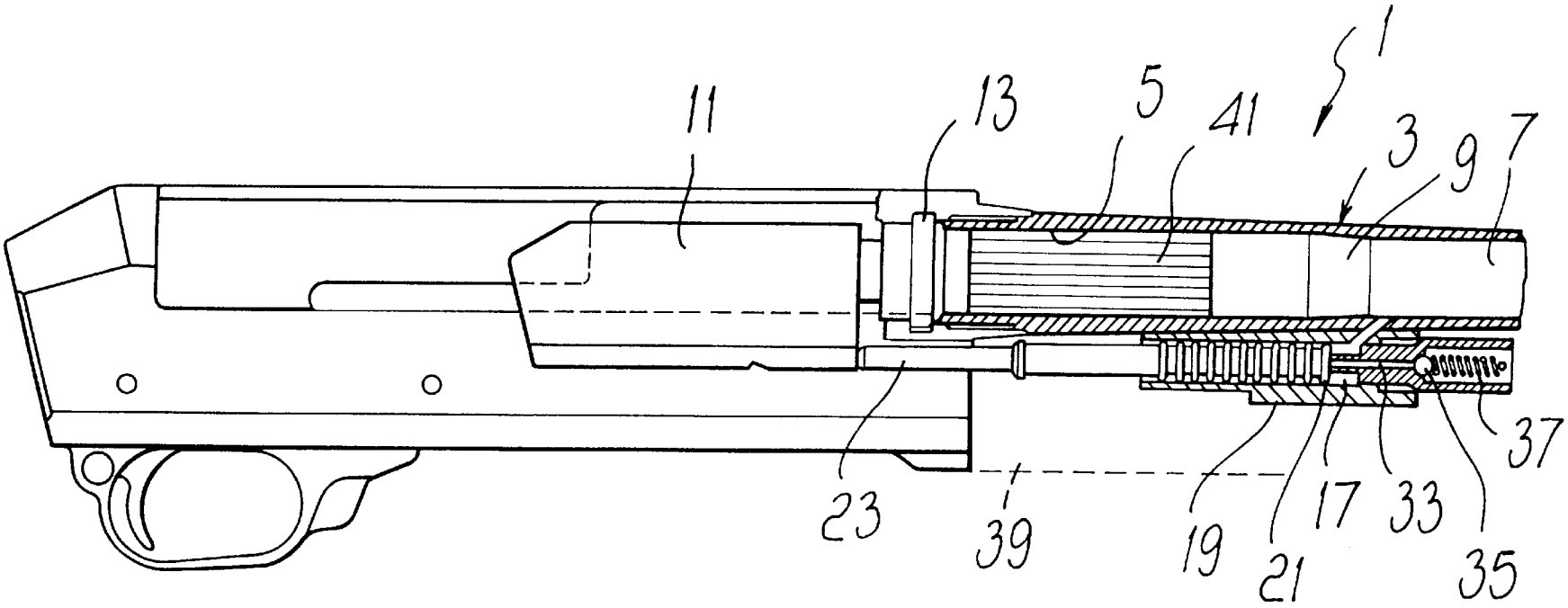
FIG. 1 is a partially and longitudinally sectional side view of a portion of a shotgun according to the invention, illustrated in the position in which the breech is closed and the cartridge is in the barrel.

With reference to the above figures, a gas-operated shotgun, generally designated by the reference numeral 1, includes a barrel 3 having a cartridge chamber 5 that is connected with the cylindrical portion 7 of the barrel by a cone portion 9. A breech block 11 is actuated by a kinematic system receiving energy from gas that arrives from a gas port formed in the barrel in a per se known manner. In the present example, a smoothbore shotgun has a breech block 11 with a rotating head 13, of the type described for example in Italian patent No. 1.172.795 and in the corresponding European patent No. 0128125 and U.S. Pat. No. 4.604.942, in the name of this same Applicant. For the sake of brevity, the operation of the breech block 11, which is per se known and has been described extensively in these prior patents, will not be repeated herein. However, it is evident that any other type of breech block can be used in the weapon according to the invention.

Shotgun 1 includes at least one gas port 15 that is located in cylindrical portion 7 of barrel 3, proximate to cone 9, less than a length of cone 9 forward of cone 9, and is suitable to connect the bore of barrel 3 to an expansion chamber 17 that is formed inside a cylinder 19 associated with the barrel 3 of the weapon.

Expansion chamber 17 is formed, at one end, by a piston 21 that can slide inside cylinder 19 and is associated with an actuation rod 23 adapted to act on breech block 11 and, at the other end, by a closure 25.

Closure 25 is constituted by a threaded cylindrical body adapted to engage a corresponding thread 27, formed in cylinder 19. The cylindrical body includes a protrusion 29 adapted to abut against the end of piston 21. Closure 25 also includes a pressure limiting valve 31 constituted by a hole 33 that can be closed by a ball 35 that can move in contrast with a spring 37.

Figure 3:
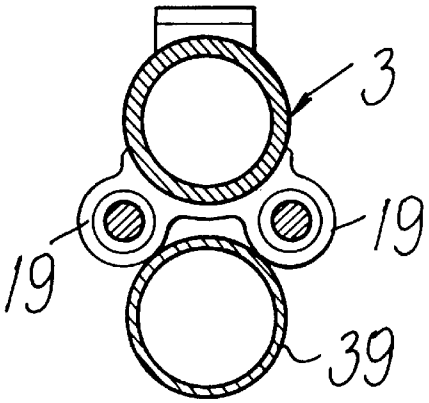
FIG. 3 is a partial sectional front view of the shotgun.
Figure 4:
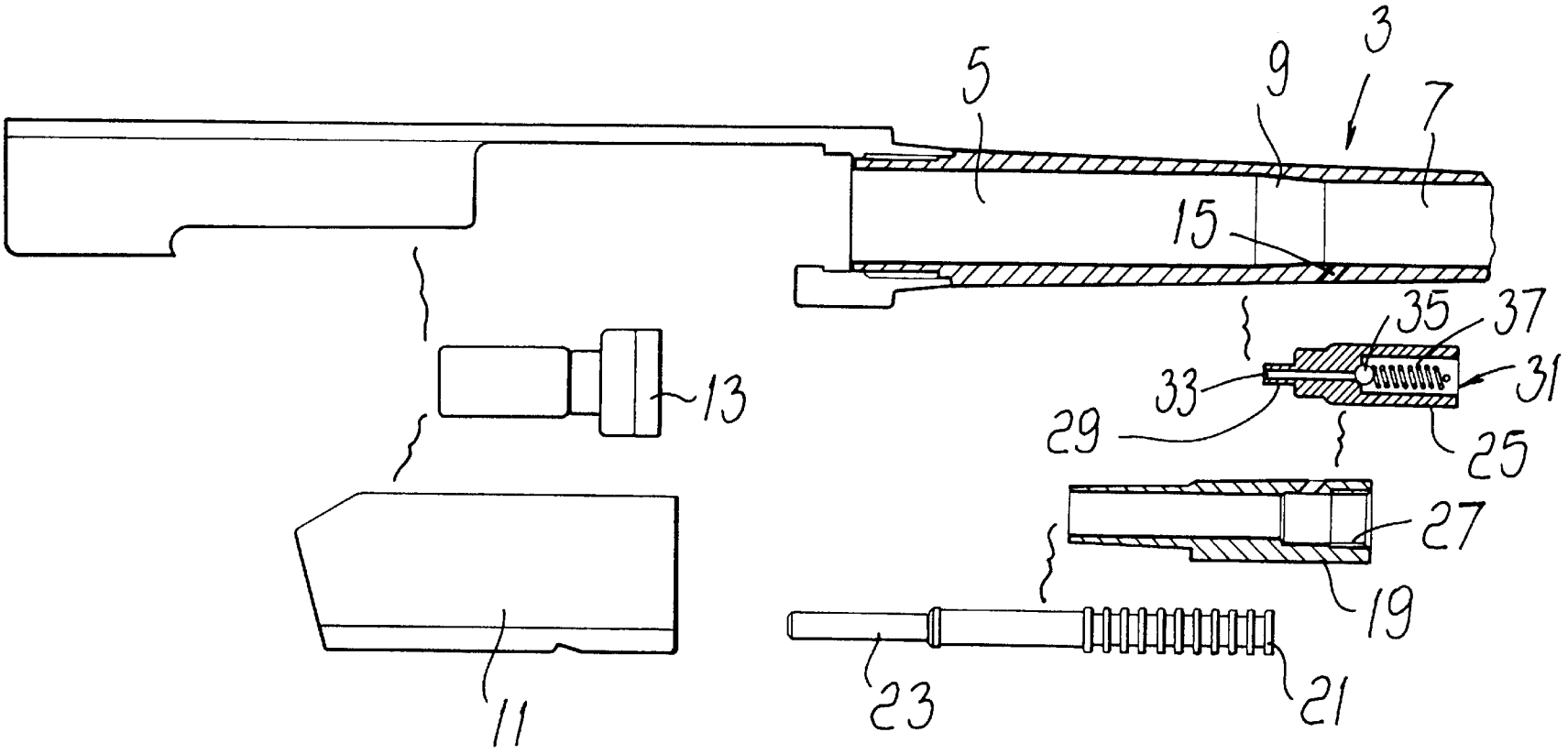
FIG. 4 is an exploded side view of the shotgun according to the invention.

In the illustrated example, the shotgun according to the invention advantageously has two cylinders 19 that are arranged at the sides, between barrel 3 and magazine 39, as shown in FIG. 3. However, it is also possible to use a single cylinder according to the specific requirements and to the type of weapon.

The operation of the shotgun according to the invention is as follows.

In FIG. 1, the firearm is shown in the idle position, ready to fire, with the breech closed, cartridge 41 in the barrel, and expansion chamber 17 empty.

Figure 2:
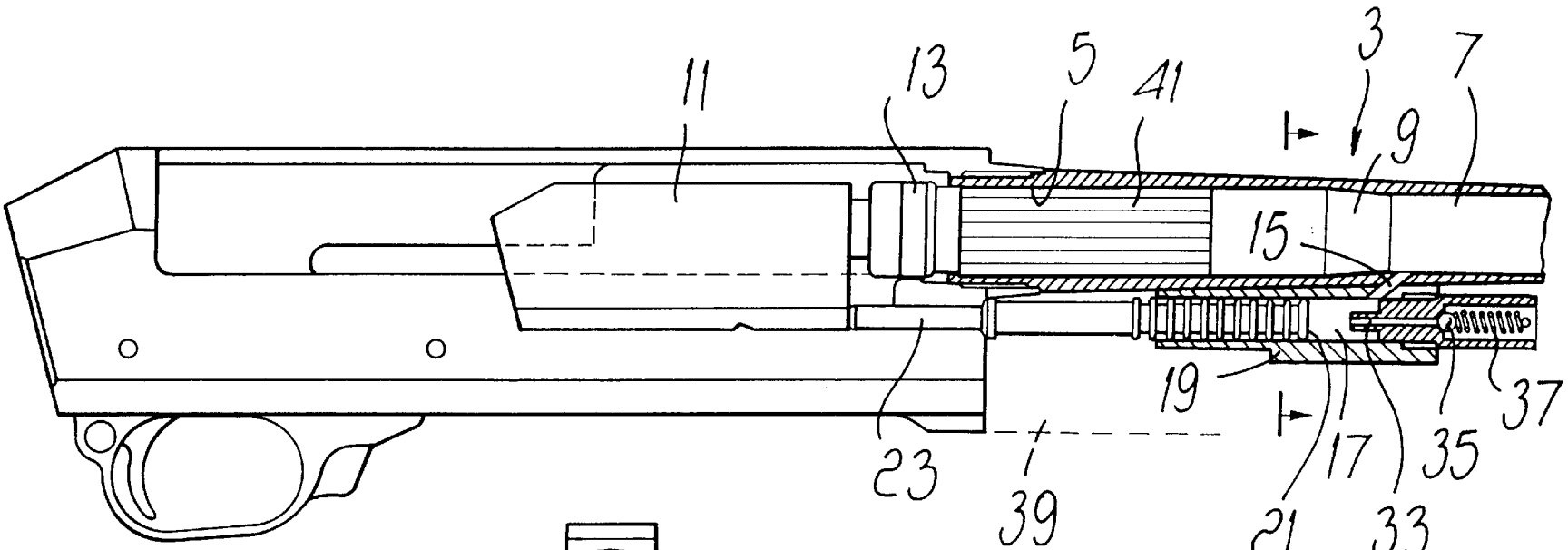
FIG. 2 is a view, similar to FIG. 1, but in the position in which the breech block is moving backward and the cartridge is moving out.

A fraction of the gases produced upon firing enters expansion chamber 17 through gas port 15, moving backward (to the left with reference to FIGS. 1 and 2) piston 21, which, by means of rod 23, pushes breech block 11 so that it opens, as shown in FIG. 2. Any excess pressure is absorbed by the pressure limiting valve 31. FIG. 2 shows the breech block as it moves backward and cartridge 41 as it leaves barrel 3. The operation of the breech block and of the loading system is per se known and is not described herein. It is also evident that the system for closing the breech, loading, and feeding the firearm may be different from the illustrated example according to the requirements.

It has been observed in practice that the invention achieves the intended aim and objects, providing a shotgun which, by virtue of the characteristic position of the gas port near the cartridge chamber, can be provided with any barrel length according to the requirements.

A further advantage of the invention is that the gas is taken when the pressure is highest, ensuring excellent operation even with the weakest cartridges.

A further important advantage is that the gas cylinder has a substantially smaller diameter than conventional cylinders. In practice, the diameter of the gas cylinder according to the invention is approximately half of conventional ones, thereby reducing the gas portion taken from the cartridge chamber, with consequent less clogging of the cylinder and of the piston and less energy drawn from the charge of the cartridge. This also reduces undesired effects on the shooting pattern.

Furthermore, upon firing a round, the recoil of the shotgun would cause the bolt to initially contrast the thrust of the pistons because of their reduced diameter. This would cause a delay in the opening of the bolt and this delay is added to the delay caused by the rotating bolt head. The operation of the firearm is thus greatly improved especially when using rounds with cardboard shells.

The position of the gas port according to the invention can vary with respect to the illustrated embodiment; it has in fact been observed that it can be placed even further back, even in the cartridge chamber.

The shotgun according to the invention is susceptible of numerous modifications and variations, all within the scope of the appended claims; all the details may be replaced with technically equivalent elements.

The materials employed, as well as the dimensions, may of course be any according to the requirements and the state of the art.

We claim:

1. A gas-operated automatic firearm comprising:

a barrel having a cylindrical portion and a cartridge chamber connected to one another by a blending cone;

a breech block connected to said barrel for closing said cartridge chamber;

a cylinder connected to said barrel and extending substantially parallel thereto;

a piston at least partially disposed in said cylinder and operatively coupled via a rod to said breech block for opening said breech block to automatically reload the firearm;

a closure attached to said cylinder, said cylinder and said piston together with said closure defining an expansion chamber;

gas port means defining at least one gas port extending to said expansion chamber for drawing off a portion of gas generated on discharge of a round in said cartridge chamber, to actuate said piston, said gas port having an inlet portion located along said cylindrical portion and proximate to said cartridge chamber at a distance of less than a length of the blending cone from said blending cone; and a pressure limiting valve mounted to said closure.

2. The firearm according to claim 1 wherein said breech block comprises a rotating closure head.

3. A gas-operated automatic firearm comprising:

barrel having a cylindrical portion and a cartridge chamber;

a breech block connected to said barrel for closing said cartridge chamber;

two cylinders connected to said barrel on opposing sides thereof and extending substantially parallel thereto;

two pistons each at least partially disposed in a respective one of said cylinders and operatively coupled via a respective rod to said breech block for opening said breech block to automatically reload the firearm;

two closures each attached to a respective one of said cylinders, each of said cylinders and the respective piston together with the respective closure defining an expansion chamber;

gas port means located proximately to said cartridge chamber and defining two gas ports each extending to a respective said expansion chamber for drawing off a portion of gas generated on discharge of a round in said cartridge chamber, to actuate said pistons; and two pressure limiting valves each mounted to a respective one of said closures.

4. The firearm according to claim 3 wherein said breech block comprises a rotating closure head.

* * * * *